United States Patent [19]

Goodwin

[11] Patent Number: 5,052,578

[45] Date of Patent: Oct. 1, 1991

[54] CLOSURE FOR A SHIPPING CONTAINER

[76] Inventor: William A. Goodwin, 111 Lomor Dr., Longview, Wash. 98632

[21] Appl. No.: 486,135

[22] Filed: Feb. 28, 1990

[51] Int. Cl.[5] ..... B65D 43/04

[52] U.S. Cl. ..... 220/352; 220/254; 215/364; 229/125.17; 229/160.2

[58] Field of Search ..... 215/306, 364; 220/352, 220/356, 357; 229/125.09, 125.17, 125.19, 125.21

[56] References Cited

U.S. PATENT DOCUMENTS

| | | | |
|---|---|---|---|
| 196,260 | 10/1877 | Stewart | 215/364 X |
| 1,361,618 | 12/1920 | Rose | 229/125.17 X |
| 2,357,092 | 8/1944 | DeMien et al. | 220/352 X |
| 2,713,845 | 7/1955 | Silverman | 220/352 X |

*Primary Examiner*—Stephen Marcus
*Assistant Examiner*—Nova Stucker
*Attorney, Agent, or Firm*—James D. Givnan, Jr.

[57] ABSTRACT

A closure for a tubular shipping or storage container and having a disc component for abutment with the end of the container with bendable tabs for engagement with the exterior of the container for securement as by stapling, adhesives, etc. An insert is centrally disposed on the disc for seated engagement with the inner wall of the container. The insert may be of yieldable construction such as corrugated paper board or a foam material to protect a container housed article against impact loads. A fold line along a tab permits the closure to serve as a hingedly attached lid for the tubular container. A door in the disc and an aligned insert opening permit finger insertion for purposes of closure removal.

12 Claims, 1 Drawing Sheet

CLOSURE FOR A SHIPPING CONTAINER

BACKGROUND OF THE INVENTION

The present invention pertains generally to closures for containers in which articles are shipped and, in some instances, stored.

In the art are various types of closures for spiral-wound or molded tubular shipping containers. Drawbacks to known closures include high cost of manufacture, disposal costs and only one time use. A need exists for a secure closure for containers of various sizes subject to severe use as encountered in commercial or industrial areas.

SUMMARY OF THE PRESENT INVENTION

The present invention is embodied within a closure for convenient, secure installation in the open end of an elongate container typically constructed from a synthetic or natural material.

The present closure includes a disc having projections or tabs which, during closure installation, are displaced into engagement with the outer wall of the container end whereat the same may be secured in place by various means, as for example, stapling. The disc end abuts the container while an insert of the closure sets in a snug manner within an end segment of the container. Construction of the insert from yieldable material provides a cushion for the contained article in case of forceful contact with the closure. Further, the insert provides against entry of foreign matter into the container. The closure is reusable to permit use of the tubular container as a clean storage container.

Important objectives include the provision of a closure of low cost manufacture effecting secure closure of a shipping container in a reusable manner; the provision of a closure which lends itself to low cost production and disposal; the provision of a closure that permits a snug fit with the container end with a finger grip opening, normally closed by a door, permitting forceful manual installation and closure removal.

DETAILED DESCRIPTION OF THE PREFERRED EMBODIMENTS

Figure 1:
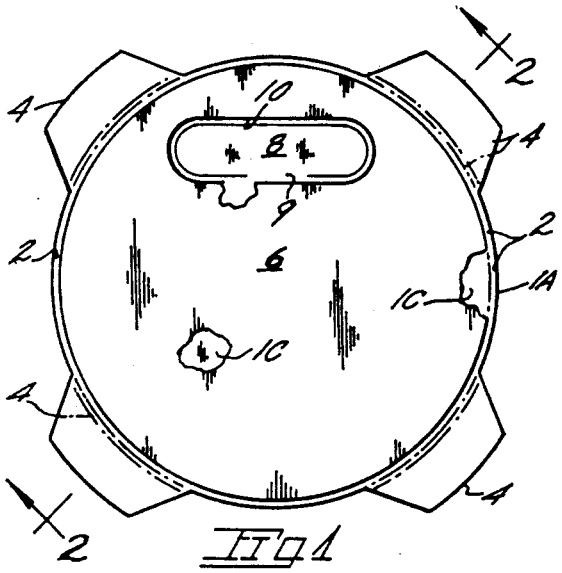
FIG. 1 is an elevational view of the internal or insert end of the present closure.

With continuing attention to the drawings wherein applied reference numerals indicate parts similarly hereinafter identified, the reference numeral 1 indicates the disc of the present closure having a peripheral edge 1A and an outer face 1B.

Figure 2:
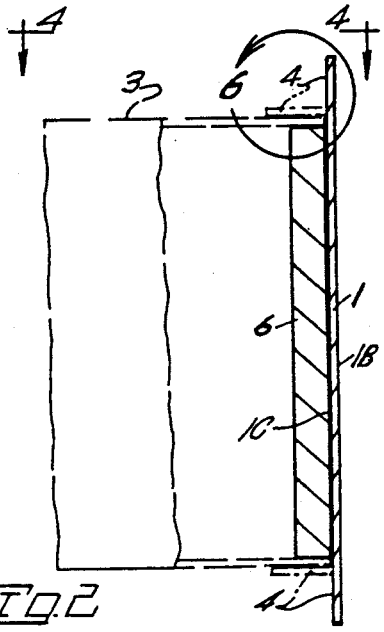
FIG. 2 is an upright sectional view of the closure taken along line 2—2 of FIG. 1.
Figure 3:
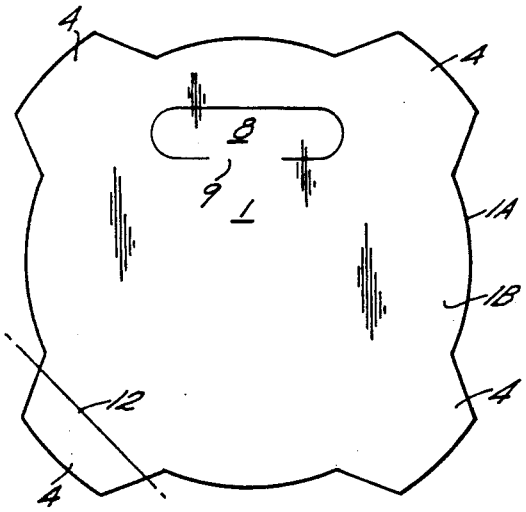
FIG. 3 is an elevational view of the external or disc end of the closure.
Figure 4:
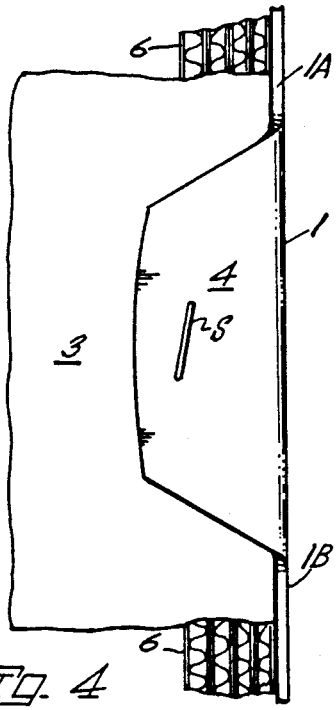
FIG. 4 is an enlarged fragmentary view taken downwardly along line 4—4 of FIG. 2 with a fragment of a container wall show in solid lines.

The disc is of a size to have a peripheral margin 2 which overlies the outer end of a tubular container at 3 with the peripheral edge 1A substantially concentric with the outer wall of the container. The disc is provided with tabs 4 extending outwardly from disc edge 1A. The tabs are adapted for manual displacement toward the outer surface of the container and toward this end an indentation at 5 (FIG. 6) may be provided along the base of each tab. As shown in FIG. 2 in broken lines, each tab is bendable into contact with the container outer wall whereat tab securement may be completed as by stapling or an adhesive. In some instances the tabs may be taped to the container. A staple is indicated at S.

An insert at 6 is secured in place on the inner side or face 1C of the disc and has a circumferential wall which corresponds to the interior wall surface of the container to enable frictional engagement between insert and container. When so sized, the insert constitutes a virtually airtight closure for the container to prevent the entry of foreign matter during shipping or storage use of same.

A finger pull opening 10 is provided in the insert which is accessible via a die cut door 8 in the disc. The door is normally closed with an uncut area of the disc constituting a hinge 9 enabling finger access permitting the application of or a removal or outward force on the closure. Door 8 is closed prior to reinstallation of the closure.

Figure 5:
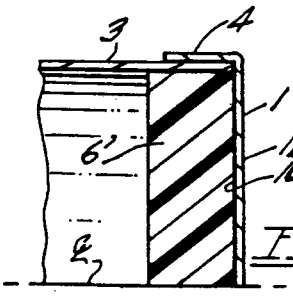
FIG. 5 is a sectional view of a modified closure.

A desirable feature of the present closure results from the formation of the insert from impact absorbing material, as for example, fibrous material such corrugated paper board which may be of any desired thickness achieved as by laminating sheets of corrugated material. In FIG. 5 a fragment is shown of a closure having an insert 6' of a synthetic, expanded foam material which can yield to impact forces yet effect desired frictional engagement with an internal wall segment of a tubular container. The insert 6 may be adhesively secured to the inner face 1C of disc 1.

In using the closure, it may be desirable to permit one of said tabs to remain attached to container 3 to permit the closure to swing about a flex line at 12 to provide an effective closure for a container used for storage purposes.

A suitable material for disc 1 is paper chipboard for low cost as well as convenient disposal particularly when combined with an insert of biodegradable material.

Figure 6:
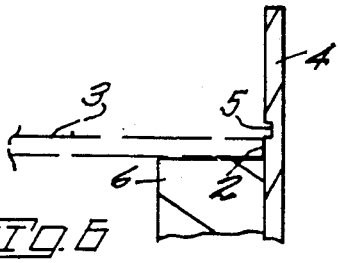
FIG. 6 is an enlarged view of that structure encircled at 6 in FIG. 2.

The peripheral margin 2 of the present closure will have a width approximating the wall thickness of the container as best shown in FIG. 6.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A closure for a tubular container comprising, a disc including flexible tabs positionable into contact with the exterior of the tubular container for attachment thereto, said disc having a peripheral margin for abutment with an end of the tubular container, said margin having a transverse dimension corresponding to the wall thickness of the tubular container, and an insert centrally disposed on said disc for installation within an end of said tubular contain. ·, said insert having a perimeter for frictional engagement with the inner surface of the tubular container.

2. The closure claimed in claim 1 wherein said insert is of organic fibrous material.

3. The closure claimed in claim 1 wherein said tabs are circumferentially spaced from one another about the periphery of said disc.

4. The closure claimed in claim 1 wherein said insert is of impact absorbing material to protect an article in the container.

5. The closure claimed in claim 1 wherein said disc is of organic fibrous material.

6. The closure claimed in claim 1 wherein said insert is of synthetic foam construction.

7. The closure claimed in claim 1 wherein said insert defines an opening for finger entry.

8. The closure claimed in claim 7 wherein said disc includes a door normally overlying the opening in said insert.

9. A closure for a tubular cylindrical container comprising, a disc including flexible tabs spaced about the disc and bendable into contact with the exterior of the tubular container for attachment thereto, means for attaching each of said tabs to the container, and an insert of fibrous material centrally mounted on said disc for insertion within an end of said tubular container, said insert having a circumferential wall on a radius corresponding to the inner wall of the tubular container for engagement therewith.

10. The closure claimed in claim 9 wherein at least one of said tabs embodies a flex line permitting repeated opening and closing movement of the closure, said means embodied in a staple.

11. The closure claimed in claim 9 wherein said insert defines an opening for finger entry.

12. The closure claimed in claim 11 wherein said disc includes a door normally overlying the opening in said insert.

* * * * *